US008489313B2

(12) United States Patent
Vollmer et al.

(10) Patent No.: US 8,489,313 B2
(45) Date of Patent: Jul. 16, 2013

(54) METHOD AND APPARATUS FOR IDENTIFYING THROUGH TRAFFIC

(75) Inventors: Rudolph Vollmer, Diekholzen (DE); Joachim Rentel, Giesen/Emmerke (DE)

(73) Assignee: Robert Bosch GmbH, Stuttgart (DE)

( * ) Notice: Subject to any disclaimer, the term of this patent is extended or adjusted under 35 U.S.C. 154(b) by 754 days.

(21) Appl. No.: 12/161,101

(22) PCT Filed: Jan. 3, 2007

(86) PCT No.: PCT/EP2007/050021

§ 371 (c)(1), (2), (4) Date: Apr. 20, 2010

(87) PCT Pub. No.: WO2007/082783

PCT Pub. Date: Jul. 26, 2007

(65) Prior Publication Data

US 2010/0198487 A1 Aug. 5, 2010

(30) Foreign Application Priority Data

Jan. 17, 2006 (DE) ..... 10 2006 002 376

(51) Int. Cl.
*G06G 1/00* (2006.01)

(52) U.S. Cl.
USPC ..... 701/117; 701/50; 701/57; 340/539.12; 340/539.14; 375/130; 375/141; 375/146; 375/259

(58) Field of Classification Search
USPC ..... 701/50, 117, 57; 375/130, 141, 146, 375/259; 340/539.12, 539.14; 600/259
See application file for complete search history.

(56) References Cited

U.S. PATENT DOCUMENTS

| | | | | |
|---|---|---|---|---|
| 6,018,697 | A * | 1/2000 | Morimoto et al. | 701/411 |
| 6,581,005 | B2 * | 6/2003 | Nakayama et al. | 701/446 |
| 6,768,944 | B2 * | 7/2004 | Breed et al. | 701/301 |
| 7,085,637 | B2 * | 8/2006 | Breed et al. | 701/38 |
| 7,327,250 | B2 * | 2/2008 | Harvey | 340/539.13 |
| 2004/0054687 | A1 * | 3/2004 | McDonough | 707/104.1 |
| 2005/0017855 | A1 | 1/2005 | Harvey | |
| 2005/0100077 | A1 * | 5/2005 | Rosen et al. | 375/130 |
| 2005/0119996 | A1 * | 6/2005 | Ohata et al. | 707/3 |
| 2005/0134440 | A1 * | 6/2005 | Breed | 340/435 |
| 2005/0156782 | A1 * | 7/2005 | Whelan et al. | 342/357.16 |
| 2007/0162537 | A1 * | 7/2007 | Juncker | 709/200 |

FOREIGN PATENT DOCUMENTS

| | | |
|---|---|---|
| CN | 1384473 | 12/2002 |
| CN | 1584937 | 2/2008 |
| DE | 101 55 501 | 5/2003 |
| EP | 0 741 373 | 11/1996 |

OTHER PUBLICATIONS

Sethi et al., Traffic analysis including non conforming behaviour via image processing, 1991, IEEE, pg. 193-201.*

Zhu et al., A New Method for Identifying Traffic Accident Black Spots Avoiding Statistical Influence, 2009, IEEE, p. 1-4.*

International Search Report, PCT/EP2007/050021, dated Apr. 26, 2007.

* cited by examiner

*Primary Examiner* — McDieunel Marc
(74) *Attorney, Agent, or Firm* — Kenyon & Kenyon LLP

(57) ABSTRACT

In a method and an apparatus for identifying through traffic, entry into and exit from a predefined area are ascertained and the transit time is used to determine whether unauthorized transit through the area has occurred.

22 Claims, 3 Drawing Sheets

Figure 1:
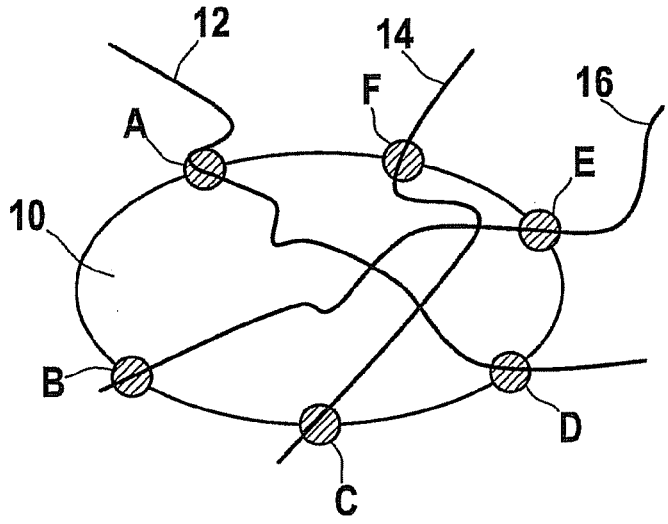

| | A | B | C | D | E | F |
|---|---|---|---|---|---|---|
| A | – | 15 | 20 | 23 | 19 | 19 |
| B | 16 | – | 10 | 22 | 24 | 18 |
| C | 20 | 10 | – | 21 | 18 | 15 |
| D | 25 | 22 | 21 | – | 15 | 13 |
| E | 20 | 24 | 18 | 16 | – | 9 |
| F | 18 | 18 | 15 | 14 | 8 | – |

Fig. 4

METHOD AND APPARATUS FOR IDENTIFYING THROUGH TRAFFIC

FIELD OF THE INVENTION

The present invention relates to methods and apparatuses for identifying through traffic.

BACKGROUND INFORMATION

For a variety of traffic categories, for example heavy loads, hazardous cargo, or heavy transports, certain roads and areas are, for various reasons (e.g. environmental reasons) closed to through traffic. These closures can be valid for a limited time, for example only for certain days of the week and/or for certain hours of the day. Corresponding traffic signs are provided for in German road and traffic legislation. At present, checks that such prohibitions are being observed are made in particular by laborious traffic inspections.

On the other hand, there exist proposals in conjunction with the charging of fees for the use of roads subject to fee, for example from European Published Patent Application No. 0 741 373, according to which stations are provided, at least upon entry into and/or exit from the area subject to fee, which recognize the passage of a vehicle and with which a unit installed in the vehicle communicates in order to calculate the fee amount.

SUMMARY

A procedure is described below that detects, in particularly advantageous fashion, whether a vehicle is transiting through an area closed to the vehicle, or whether the vehicle constitutes delivery or resident traffic. This is achieved by a detection algorithm that proceeding from a typical transit time, which preferably is a function of the vehicle type and/or time of day and/or a property of the area (e.g. number of settlements, intersections, road types). If this transit time or a reference value derived therefrom reaches or falls below a typical value, a potential violation exists, whereas if the transit time or reference value derived therefrom is exceeded, then resident or delivery traffic is probably involved.

The aforementioned automatic through traffic detection system is preferably arranged in a vehicle device, i.e. in a device that is installed in a vehicle. An algorithm derived from the aforementioned procedure executes in the vehicle terminal device. This device monitors areas and times, and transmits a corresponding datum when a potential violation of a traffic prohibition can be assumed.

It is of considerable advantage that execution of the detection algorithm occurs locally, so that data transfer is considerably reduced and considerable reliability is obtained; and that a communication from the vehicle to a central unit takes place only in the context of an appropriate result.

In particularly advantageous manner, a vehicle terminal device of this kind, whether in conjunction with a toll utilization or as a driver information or navigation system, possesses the necessary technical equipment to carry out the through traffic detection function, so that the outlay for implementation can be minimized.

Advantageously, the necessary data with regard to transit times, entry and/or exit points, etc. are stored in a protected memory region of the vehicle terminal device, changes or additions being made from outside by an update of the data. Depending on the arrangement, individual restricted areas or a plurality thereof are stored in memory.

The procedure presented is advantageously usable not only to distinguish through traffic from resident or delivery traffic, but also to detect whether hazardous-goods and/or heavy transports are passing through prohibited areas or deviating from predetermined routes.

Advantages are evident from the description below of exemplifying embodiments.

DETAILED DESCRIPTION

Figure 2:
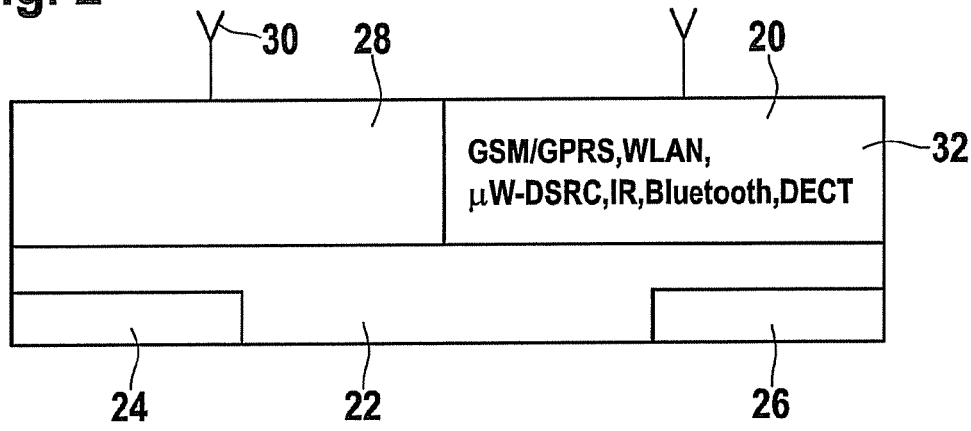
Figure 3:
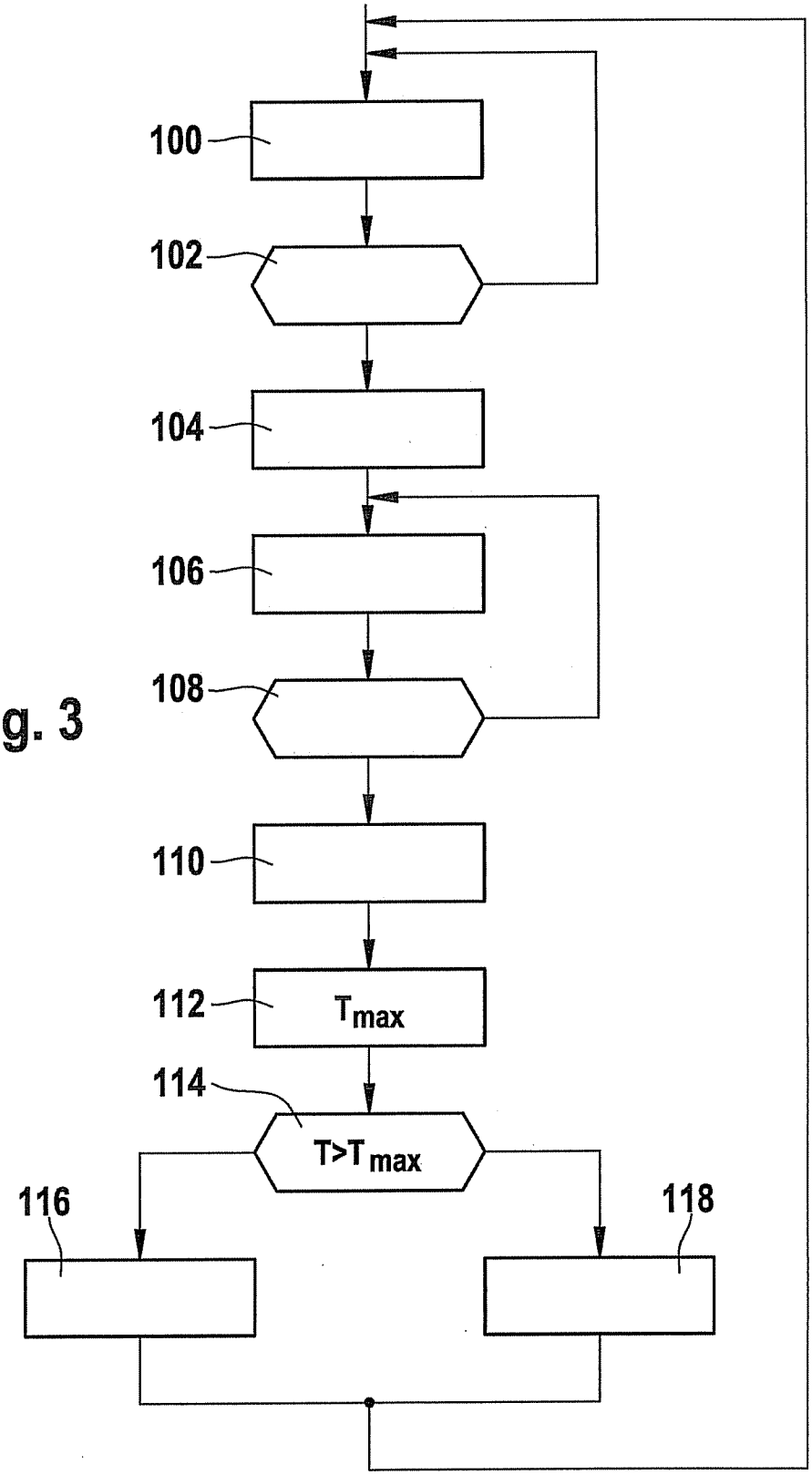

Example embodiments of the present invention will be further explained below with reference to the drawings. FIG. 1 shows, with reference to a schematic sketch, the basic procedure for through traffic detection, whereas FIG. 2 depicts an exemplifying embodiment of an apparatus for automatic through traffic detection that is installed in the motor vehicle. FIG. 3 sketches, on the basis of a flow chart, an example embodiment of the computer program executed in the vehicle terminal device for automatic through traffic detection. FIG. 4 is a table for reference transit times of a fictitious area.

FIG. 1 depicts, for example, an area 10 that is closed to through traffic, in particular to certain classes of vehicle such as, for example, heavy-load traffic. The area has various roads 12, 14, 16 passing through it, and comprises various entry and exit points (A-F).

For automatic through traffic detection, passage past an entry point A-F and passage past one of the exit points A-F of the restricted area is detected in the terminal device installed in the vehicle. This is accomplished, in the example embodiment, on the basis of a position determination system of the vehicle, for example based on GPS or Galileo signals. In other exemplary embodiments, apparatuses (e.g. beacons) with which entry and exit of a vehicle is detected are present at the entry and exit points. Further alternatives encompass other position determination methods such as, for example, dead reckoning methods.

In addition to passage past entry and/or exit points of a restricted area, a determination is made of the presence time spent by the vehicle in this area delimited by the entry and exit points. This transit time is compared a stored reference time for the route between the entry and exit point. If this reference time is exceeded, it is assumed that delivery or resident traffic was in fact involved, whereas if the time falls below that value, it is apparent that a violation against the transit prohibition exists.

In the exemplifying embodiment, the reference value depends on a variety of factors. A specific transit time that is typical for the restricted area is defined, for example, for every possible combination of entry point and exit point. The reference value is also, depending on the embodiment, defined as a function of factors such as vehicle type (e.g. car, truck, motorcycle) and/or time of day (night, rush hour, etc.) and/or properties of the area (number of intersections, towns, etc.).

If the vehicle's measured presence time in an area reaches or falls below the reference transit time in that area, this constitutes a potential violation, since resident and delivery traffic has longer travel times for the area.

The reference transit time can also be dependent on the direction of travel, since the transit time can be different in each direction because of slopes or a different number of traffic signals. For example, a trip from A to B may have a different typical transit time than a trip from B to A.

FIG. 4 depicts an example of a table of reference transit times (in minutes), stored in the memory of the vehicle terminal device, for an area as sketched in FIG. 1.

FIG. 2 shows a terminal device 20 that is installed in the vehicle and serves to carry out the through traffic detection algorithm as outlined above. Vehicle terminal device 20 has a computer element 22 that has at least one memory 24 as well as input and output wiring 26. The terminal device furthermore encompasses at least one position determination system 28, for example a GPS system, that receives the signals necessary for position determination via an antenna 30, and ascertains the vehicle position from these signals. A further constituent of the vehicle device is a communication unit 32, for example a communication unit to a mobile radio network (e.g. GSM, GPRS, UMTS), and/or a short-range communication connections such as, for example, WLAN, infrared, Bluetooth, DECT, DSRC, etc. The apparatus depicted in FIG. 2 can be a unit used specifically for through traffic detection, or can be a device that is already present, e.g. a telematics device, a tolling device, a navigation device, etc., or a part of such a device.

The coordinates of the entry and exit points of areas closed to through traffic are stored in the memory of this unit, preferably as geographical coordinates (longitude, latitude, plus capture radius in each case). When the vehicle drives through an entry point into the restricted area, its passage past the entry point is sensed on the basis of a comparison of the measured vehicle position and the stored position value range of the entry point. The time spent by the vehicle in the area since the entry point, and/or the positions of the vehicle, are then automatically sensed and stored in the internal memory. When the vehicle reaches an exit point (which, as depicted, is ascertained in conjunction with the entry point), the presence time between passing the entry point and reaching the exit point is then ascertained, and is compared with a reference transit time stored for that route of travel. The reference transit times are stored in the memory as a table. If the measured presence time is less than or equal to the predetermined reference time, which in the exemplifying embodiment is made up of a reference transit time plus a reserve time, then a violation of the through traffic prohibition exists with high probability.

The vehicle identification number, the times at which the entry and/or exit point is passed, and/or the vehicle trajectory (track) also recorded on the basis of the acquired positions are then, if applicable, compressed and/or coded in the vehicle device, and transmitted via the communication unit to a monitoring center.

If the measured travel time is greater than the reference time, then resident traffic or delivery traffic is present with high probability. In this case two variants for a further procedure are possible. It can be essentially be assumed that with such a constellation, there is no violation of the through traffic limitation. The result is that if the through traffic limitation is disregarded and the reference time is exceeded, for example, because of a traffic jam, accident, stoppage, etc., this disregard will not be detected. Communication costs to the center are not incurred. Another variant is that the aforementioned data are transmitted, optionally in compressed and/or coded fashion, to the monitoring center via the communication unit, and a decision is then made in the monitoring center, based on the route of travel, as to whether or not a violation of the transit limitation exists.

Both the entry and exit points and the reference transit time are updated via the communication interface of the vehicle device.

Additionally or alternatively, in an example embodiment, updating of these data via the communication interface is performed dynamically, i.e. as a function of time of day and/or current traffic conditions. In the case of, for example, areas that are closed as a function of time of day, the data are loaded into the vehicle device's memory only during the corresponding time period. Additionally or alternatively, when traffic jams are reported in an area, the reference times in that area are adapted on the basis of these traffic jam reports, and updated via radio.

The area and reference-time data are stored in manipulation-proof fashion in the vehicle device's memory. Depending on the size of the vehicle device's memory, a predetermined number of areas having transit limitations are kept on hand.

The aforementioned arrangement for automatic through traffic detection is also used to detect hazardous goods traffic in areas closed to hazardous cargo (e.g. because of tunnels or for watershed protection). Geographic data for the corresponding restricted areas are then provided in the terminal device of the hazardous goods transporter. As presented above a message is sent when transit through such an area is detected. In an example embodiment, the reference time for such areas is set to a very high value, so that any passage (even with a break) generates a message.

It also becomes possible to detect heavy transports on roads that have not been registered for heavy transport. Here as well, the areas that are restricted, i.e. are located outside the registered road network, are programmed into the vehicle unit via geographic data. Entries into and exits from such areas are logged as set forth above, and messages are sent.

In another example embodiment, the aforementioned procedure is utilized inversely. The registered route is programmed in as an area, a reference time is predefined, and the presence time in the area is acquired. If the presence time is greater than or less than the reference time plus a grace period, a message is sent.

FIG. 3 shows an example embodiment of the procedure presented above, as a computer program. The program is executed at predetermined time intervals, for example several milliseconds, and runs in the vehicle terminal device.

After the program starts, in the first step 100 the vehicle's current position is sensed by the position determination unit. In step 102 is then compared with the stored positions of entry and exit points of restricted areas, preferably only those adjacent to the current position. If the measured position corresponds to an entry point, or if the position is located in the capture region of an entry point, the program continues with step 104; otherwise step 100 is repeated.

If step 102 detects that the vehicle is driving into a restricted area, then in step 104 a timer T is started. In addition, in order to prevent an entry point from being detected more than once, a marker is set for the entry point, preventing the same entry point from being detected a second time in another program cycle. The vehicle's position value is also stored. In the next step 106, the vehicle's position is determined again, and step 108 checks whether the position is located within the capture region of a predetermined exit point of the area in which the vehicle is located. If not, the program repeats with step 106. The exit points checked in step 108 are all exit points of that area. If an exit point is detected in step 108, timer T is stopped in step 110. In step 112, the reference time Tmax is then read out from the table in memory for the predetermined route, along with (if applicable) the vehicle type, direction of travel, time of day, weather conditions, etc. The following step 114 checks whether the measured time T is greater than the reference time. If so, step 116 detects that resident or delivery traffic was apparently involved, whereas in the opposite case, a transmission of predetermined data to a monitoring center is initiated in step 118. After step 116 or 118, the program repeats in step 100.

What is claimed is:

1. A computer-implemented method for identifying through traffic, the method comprising:

sensing a position of a vehicle being sensed;

detecting entry into and exit from a predefined area based on the vehicle position;

ascertaining, by a processor, a time spent by the vehicle in the area by an entry and exit point to provide a measured presence time;

comparing the measured presence time with a predetermined reference time; and indicating whether the measured presence time in the area falls below the predetermined reference time.

2. The method according to claim 1, wherein the predefined time is stored in a memory.

3. The method according to claim 1, wherein the reference time depends on a combination of at least one of (a) the entry and exit point, (b) a time of day, (c) a vehicle type, (d) a direction of travel, and (e) weather conditions.

4. The method according to claim 1, wherein the indicating includes sending predefined data to a monitoring center from a vehicle terminal device in which the method executes.

5. The method according to claim 4, wherein the predefined data includes at least one of (a) a vehicle identification number, (b) a route traveled, (c) the presence time, and (d) or transit time.

6. The method according to claim 1, wherein the reference time and the predefined area are updated dynamically via a communications interface.

7. The method according to claim 1, wherein the predefined time is stored in a memory, and wherein the reference time depends on a combination of at least one of (a) the entry and exit point, (b) a time of day, (c) a vehicle type, (d) a direction of travel, and (e) weather conditions.

8. The method according to claim 7, wherein the indicating includes sending predefined data to a monitoring center from a vehicle terminal device in which the method executes, and wherein the predefined data includes at least one of (a) a vehicle identification number, (b) a route traveled, (c) the presence time, and (d) or transit time.

9. The method according to claim 8, wherein the reference time and the predefined area are updated dynamically via a communications interface.

10. The method according to claim 7, wherein the reference time and the predefined area are updated dynamically via a communications interface.

11. An apparatus for through traffic detection, comprising:

a terminal device installed in a vehicle that has a position determination system and a computer unit having a memory;

wherein the computer unit is configured to detect entry into and exit from a predefined area based on a position of the vehicle, to determine a measured presence time in the predefined area, to compare the measured presence time with a predetermined reference value, and to provide an indication whether the presence time falls below the reference value.

12. The apparatus according to claim 11, wherein the predefined time is stored in a memory.

13. The apparatus according to claim 11, wherein the reference time depends on a combination of at least one of (a) the entry and exit point, (b) a time of day, (c) a vehicle type, (d) a direction of travel, and (e) weather conditions.

14. The apparatus according to claim 11, wherein the indication includes sending predefined data to a monitoring center from a vehicle terminal device in which the method executes.

15. The apparatus according to claim 14, wherein the predefined data includes at least one of (a) a vehicle identification number, (b) a route traveled, (c) the presence time, and (d) or transit time.

16. The apparatus according to claim 11, wherein the reference time and the predefined area are updated dynamically via a communications interface.

17. The apparatus according to claim 11, wherein the predefined time is stored in a memory, and wherein the reference time depends on a combination of at least one of (a) the entry and exit point, (b) a time of day, (c) a vehicle type, (d) a direction of travel, and (e) weather conditions.

18. The apparatus according to claim 17, wherein the indication includes sending predefined data to a monitoring center from a vehicle terminal device in which the method executes, and wherein the predefined data includes at least one of (a) a vehicle identification number, (b) a route traveled, (c) the presence time, and (d) or transit time.

19. The apparatus according to claim 18, wherein the reference time and the predefined area are updated dynamically via a communications interface.

20. The apparatus according to claim 17, wherein the reference time and the predefined area are updated dynamically via a communications interface.

21. A computer-implemented method for identifying through traffic, comprising:

sensing a position of a vehicle being sensed;

detecting entry into and exit from a predefined area based on the vehicle position;

ascertaining, by a processor, a measured presence time spent by the vehicle in the area by an entry and exit point;

comparing the measured presence time with a predetermined reference time; and indicating whether the measured presence time in the area exceeds the predetermined reference time.

22. An apparatus for through traffic detection, comprising:

a terminal device installed in a vehicle that has a position determination system and a computer unit having a memory;

wherein the computer unit is configured to detect entry into and exit from a predefined area based on a position of the vehicle, to determine a measured presence time in the predefined area, to compare the measured presence time with a predetermined reference value, and to provide an indication whether the measured presence time exceeds the predetermined reference value.

* * * * *

UNITED STATES PATENT AND TRADEMARK OFFICE

CERTIFICATE OF CORRECTION

PATENT NO. : 8,489,313 B2
APPLICATION NO. : 12/161101
DATED : July 16, 2013
INVENTOR(S) : Vollmer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1399 days.

Signed and Sealed this
Eighth Day of September, 2015

Michelle K. Lee

Michelle K. Lee
*Director of the United States Patent and Trademark Office*